US010538829B2

(12) United States Patent
Gopalrao et al.

(10) Patent No.: US 10,538,829 B2
(45) Date of Patent: Jan. 21, 2020

(54) HARD MATERIAL AND METHOD OF MAKING THE SAME FROM AN AQUEOUS HARD MATERIAL MILLING SLURRY

(71) Applicant: Kennametal India Limited, Bangalore (IN)

(72) Inventors: Sivaraman Gopalrao, Bangalore (IN); Raghavan Rengarajan, Bangalore (IN); Ramesh S. Rao, Bangalore (IN); Alam Rukhsar, Odisha (IN)

(73) Assignee: KENNAMETAL INDIA LIMITED, Bangalore (IN)

( * ) Notice: Subject to any disclaimer, the term of this patent is extended or adjusted under 35 U.S.C. 154(b) by 1399 days.

(21) Appl. No.: 14/497,742

(22) Filed: Sep. 26, 2014

(65) Prior Publication Data

US 2015/0098856 A1 Apr. 9, 2015

(30) Foreign Application Priority Data

Oct. 4, 2013 (IN) ..... 4500/CHE/2013

(51) Int. Cl.
*C22C 32/00* (2006.01)
*B22F 1/00* (2006.01)
(Continued)

(52) U.S. Cl.
CPC ..... *C22C 32/0052* (2013.01); *B22F 1/0003* (2013.01); *B22F 1/0059* (2013.01);
(Continued)

(58) Field of Classification Search
CPC ..... B22F 2009/041; C22C 29/06
See application file for complete search history.

(56) References Cited

U.S. PATENT DOCUMENTS 3,425,954 A 2/1969 Ruzevick et al.
3,488,291 A 1/1970 Hardy et al.
(Continued)

FOREIGN PATENT DOCUMENTS

CN 1212191 A 3/1990
CN 1997475 A 7/2007
(Continued)

OTHER PUBLICATIONS

US 8,191,280 B2, 06/2012, Hubbard, Jr. et al. (withdrawn)
(Continued)

*Primary Examiner* — Colleen P Dunn
*Assistant Examiner* — Jeremy C Jones
(74) *Attorney, Agent, or Firm* — Larry R. Meenan

(57) ABSTRACT

An aqueous emulsion for use in aqueous milling of hard material powder components in an aqueous slurry. The aqueous emulsion includes an oxidation inhibitor in an amount between about 0.3 weight percent and about 1.2 weight percent of the hard material powder components in the aqueous slurry. The aqueous emulsion also includes a paraffin wax in an amount between about 0.25 weight percent and about 0.75 weight percent of the hard material powder components in the aqueous slurry for vacuum dried powder and in an amount about up to 2.75 weight percent of the hard material powder components in the aqueous slurry for spray dried powder. The aqueous emulsion also includes myristic acid in an amount between about 0.10 weight percent and about 0.50 weight percent of the hard material powder components in the aqueous slurry. The balance of the aqueous emulsion is water.

20 Claims, 9 Drawing Sheets

(51) Int. Cl.
*B22F 9/04* (2006.01)
*C22C 29/06* (2006.01)

(52) U.S. Cl.
CPC ..... *B22F 9/04* (2013.01); *C22C 29/06* (2013.01); *B22F 2009/041* (2013.01); *B22F 2302/10* (2013.01)

(56) References Cited

U.S. PATENT DOCUMENTS

| | | | |
|---|---|---|---|
| 3,510,292 | A | 5/1970 | Hardy et al. |
| 3,846,126 | A | 11/1974 | Foley et al. |
| 3,859,056 | A | 1/1975 | Hara et al. |
| 3,895,170 | A | 7/1975 | Tanaka et al. |
| 3,985,503 | A | 10/1976 | O'Neal, Jr. |
| 3,988,524 | A | 10/1976 | Dreyer et al. |
| 4,062,678 | A | 12/1977 | Dreyer et al. |
| 4,070,184 | A | 1/1978 | Scheithauer, Jr. et al. |
| 4,129,444 | A | 12/1978 | Dreyer et al. |
| 4,184,991 | A | 1/1980 | Scheurman, III |
| 4,202,796 | A | 5/1980 | Jacob et al. |
| 4,315,889 | A | 2/1982 | McChesney et al. |
| 4,397,889 | A | 8/1983 | Benjamin et al. |
| 4,478,888 | A | 10/1984 | Benjamin et al. |
| 4,610,726 | A | 9/1986 | King |
| 4,886,638 | A | 12/1989 | Penkunas et al. |
| 4,902,471 | A | 2/1990 | Penkunas et al. |
| 5,007,957 | A | 4/1991 | Penkunas et al. |
| 5,015,332 | A | 5/1991 | Iwaya et al. |
| 5,045,277 | A | 9/1991 | Penkunas et al. |
| 5,316,573 | A | 5/1994 | Brusic et al. |
| 5,352,269 | A | 10/1994 | McCandlish et al. |
| 5,358,911 | A | 10/1994 | Moeggenborg et al. |
| 5,423,889 | A | 6/1995 | Krall et al. |
| 5,505,902 | A | 4/1996 | Fischer et al. |
| 5,584,907 | A | 12/1996 | Muhammed et al. |
| 5,590,387 | A | 12/1996 | Schmidt et al. |
| 5,594,929 | A | 1/1997 | Muhammed et al. |
| 5,603,781 | A | 2/1997 | Park et al. |
| 5,632,824 | A | 5/1997 | Grenthe et al. |
| 5,658,395 | A | 8/1997 | Wahlberg et al. |
| 5,726,267 | A | 3/1998 | Howland et al. |
| 5,880,237 | A | 3/1999 | Howland et al. |
| 5,882,376 | A | 3/1999 | Kim et al. |
| 5,885,653 | A | 3/1999 | Waldenstrom et al. |
| 5,897,962 | A | 4/1999 | Houck et al. |
| 5,908,889 | A | 6/1999 | Bailey et al. |
| 5,922,801 | A | 7/1999 | Bailey et al. |
| 5,922,978 | A | 7/1999 | Carroll |
| 5,924,216 | A | 7/1999 | Takahashi |
| 5,964,918 | A | 10/1999 | Asada et al. |
| 5,993,730 | A | 11/1999 | Waldenstrom et al. |
| 6,059,853 | A | 5/2000 | Coombs |
| 6,110,266 | A | 8/2000 | Gonzalez-Blanc et al. |
| 6,221,479 | B1 | 4/2001 | Waldenstrom et al. |
| 6,238,148 | B1 | 5/2001 | Taniuchi et al. |
| 6,245,288 | B1 | 6/2001 | Carroll |
| 6,254,658 | B1 | 7/2001 | Taniuchi et al. |
| 6,254,661 | B1 | 7/2001 | Takeda et al. |
| 6,273,930 | B1 | 8/2001 | Waldenstrom et al. |
| 6,293,989 | B1 | 9/2001 | Kim et al. |
| 6,336,951 | B1 | 1/2002 | Qvick et al. |
| 6,346,137 | B1 | 2/2002 | Hohne et al. |
| 6,352,571 | B1 | 3/2002 | Waldenstrom et al. |
| 6,398,125 | B1 | 6/2002 | Liu et al. |
| 6,402,802 | B1 | 6/2002 | Bhagat |
| 6,405,512 | B1 | 6/2002 | Tornberg |
| 6,511,551 | B2 | 1/2003 | Kim et al. |
| 6,605,251 | B1 | 8/2003 | Vidarsson |
| 6,617,271 | B1 | 9/2003 | Kadash et al. |
| 6,656,976 | B2 | 12/2003 | Bergstrom et al. |
| 6,676,730 | B2 | 1/2004 | Kim et al. |
| 6,692,690 | B2 | 2/2004 | Akerman et al. |
| 6,733,562 | B2 | 5/2004 | Knunz et al. |
| 6,767,396 | B2 | 7/2004 | McElligot et al. |
| 6,820,865 | B2 | 11/2004 | Low |
| 6,852,274 | B2 | 2/2005 | Knunz et al. |
| 6,878,182 | B2 | 4/2005 | Kruse |
| 6,887,296 | B2 | 5/2005 | Mende et al. |
| 6,918,991 | B2 | 7/2005 | Chickering, III et al. |
| 7,094,821 | B2 | 8/2006 | Kruse et al. |
| 7,153,340 | B2 | 12/2006 | Kim et al. |
| 7,258,722 | B2 | 8/2007 | Kim et al. |
| 7,285,241 | B2 | 10/2007 | Puide |
| 7,303,722 | B2 | 12/2007 | Bruhn et al. |
| 7,368,078 | B2 | 5/2008 | Nakabayashi et al. |
| 7,387,658 | B2 | 6/2008 | Grearson et al. |
| 7,470,307 | B2 | 12/2008 | Larink, Jr. |
| RE40,717 | E | 1/2009 | Waldenstrom |
| 7,485,254 | B2 | 2/2009 | Nakabayashi et al. |
| 7,507,687 | B2 | 3/2009 | Kodas et al. |
| 7,531,022 | B2 | 5/2009 | Quirmbach et al. |
| 7,537,637 | B2 | 5/2009 | Jutterstrom et al. |
| 7,537,726 | B2 | 5/2009 | Glatzle et al. |
| 7,553,443 | B2 | 6/2009 | Nakabayashi et al. |
| 7,625,542 | B2 | 12/2009 | Zhang et al. |
| 7,662,424 | B2 | 2/2010 | Kurihara et al. |
| 7,666,349 | B2 | 2/2010 | Laarz et al. |
| 7,670,988 | B2 | 3/2010 | Switzer et al. |
| 7,737,217 | B2 | 6/2010 | Kauppi et al. |
| 7,824,465 | B2 | 11/2010 | Larink, Jr. |
| 7,829,041 | B2 | 11/2010 | Nayak et al. |
| 7,879,131 | B2 | 2/2011 | Yaniv et al. |
| 7,988,759 | B2 | 8/2011 | Shimura |
| 8,114,186 | B2 | 2/2012 | Ruthner |
| 8,176,655 | B2 | 5/2012 | Gibson |
| 8,206,485 | B2 | 6/2012 | Larink, Jr. |
| 8,282,878 | B2 | 10/2012 | Croft et al. |
| 2002/0194955 | A1 | 12/2002 | Fang et al. |
| 2003/0000340 | A1 | 1/2003 | Mende et al. |
| 2005/0005732 | A1 | 1/2005 | Yaginuma et al. |
| 2005/0008523 | A1 | 1/2005 | Kruse |
| 2006/0219056 | A1 | 10/2006 | Larink, Jr. |
| 2007/0259970 | A1 | 11/2007 | Boden et al. |
| 2009/0053089 | A1 | 2/2009 | Yang et al. |
| 2009/0104530 | A1 | 4/2009 | Shizuka et al. |
| 2009/0113810 | A1 | 5/2009 | Laarz et al. |
| 2009/0252636 | A1 | 10/2009 | Christopherson, Jr. et al. |
| 2009/0285712 | A1 | 11/2009 | Gries et al. |
| 2011/0243787 | A1 | 10/2011 | Morishita et al. |
| 2012/0006676 | A1 | 1/2012 | Honecker et al. |
| 2012/0038073 | A1 | 2/2012 | Snyder et al. |

FOREIGN PATENT DOCUMENTS

| | | |
|---|---|---|
| EP | 0 331 009 A1 | 2/1989 |
| EP | 0 517 390 B1 | 5/1992 |
| EP | 0 749 560 B1 | 3/1994 |
| EP | 0 628 331 B1 | 4/1994 |
| EP | 0 725 685 B1 | 10/1994 |
| EP | 0 961 646 B1 | 2/1997 |
| EP | 0 818 224 B1 | 6/1997 |
| EP | 0 956 275 B1 | 1/1998 |
| EP | 1 384 791 B1 | 9/1999 |
| EP | 1 043 413 B1 | 3/2000 |
| EP | 0 963 454 B1 | 12/2002 |
| EP | 1 426 456 A2 | 11/2003 |
| EP | 1 486 579 A1 | 5/2004 |
| EP | 1 153 652 B1 | 3/2005 |
| EP | 1 696 051 A1 | 2/2006 |
| EP | 1 724 363 A1 | 5/2006 |
| EP | 1 995 003 A2 | 5/2007 |
| EP | 1 440 956 A1 | 7/2007 |
| EP | 1 666 616 B1 | 11/2007 |
| EP | 2 143 476 B1 | 7/2008 |
| EP | 2 055 796 A2 | 10/2008 |
| EP | 1 806 175 B1 | 3/2009 |
| EP | 1 373 585 B2 | 7/2009 |
| EP | 1 373 586 B1 | 8/2010 |
| EP | 1 739 197 B1 | 10/2010 |
| EP | 1 742 726 B1 | 2/2011 |
| WO | 93/21127 | 10/1993 |
| WO | 96/24454 | 8/1996 |
| WO | 98/00256 | 1/1998 |
| WO | 99/65840 | 12/1999 |

(56) References Cited

FOREIGN PATENT DOCUMENTS

| | | | |
|---|---|---|---|
| WO | 01/19934 | A1 | 3/2001 |
| WO | 01/21298 | A1 | 3/2001 |
| WO | 02/079531 | A2 | 10/2002 |
| WO | 02/079532 | A2 | 10/2002 |
| WO | 2006/104925 | A2 | 10/2006 |
| WO | 2008/145100 | A2 | 12/2008 |
| WO | 2010/024474 | A1 | 4/2010 |
| WO | 2011/133100 | A1 | 10/2011 |
| WO | 2011/136654 | A1 | 11/2011 |

OTHER PUBLICATIONS

US 8,356,421 B2, 01/2013, Hubbard, Jr. et al. (withdrawn)
US 8,359,767 B2, 01/2013, Hubbard, Jr. et al. (withdrawn)
Laarz et al., "Dispersing Wc-Co Powders in Aqueous Media with Polyethylenimine", International Journal of Refractory Metals and Hard Materials, 18 (2000), pp. 281-286.
Doctoral Thesis from the Royal Institute of Technology, Stockholm, Sweden (2004) entitled "Aqueous Processing of WC-Co Powders" by Karin M. Andersson.
Jul. 6, 2015 Search report 2860274.
First Office Action dated Jul. 11, 2017.
Difference Between Carboxylic Acid and Ester, available online at http://www.differencebetween.com/difference-between-carboxylic-acid-and-vs-ester/, 3 pages.

HARD MATERIAL AND METHOD OF MAKING THE SAME FROM AN AQUEOUS HARD MATERIAL MILLING SLURRY

BACKGROUND

The present invention pertains to a hard material and a method of making the hard material from an aqueous slurry of hard material powder components (e.g., carbide and metallic binder). More specifically, the present invention pertains to a hard material such as, for example, a cemented (cobalt) tungsten carbide, and a method of making such cemented (cobalt) tungsten carbide from an aqueous slurry of hard material powder components (e.g., carbide and metallic binder). The hard material possesses properties substantively meet or exceed those properties of hard materials formed from a solvent-based hard material slurry.

Heretofore, there has been an interest is using an aqueous slurry as a milling medium for the milling hard material components such as hard carbides and metallic binders. As set forth hereinafter, there are certain advantages inherent is using an aqueous milling slurry in contrast to using a solvent such as, for example, acetone, in the milling slurry. The paper by Nebelung and Thiele entitled "Technology of Aqueous Hard Metal Processing" presented at the Powder Metallurgical Symposium at Hagen on Nov. 26-27, 2009 lists a number of patent documents that pertain to aqueous hard metal processing. Other publications that pertain to aqueous hard material processing include Laarz et al., "Dispersng WC—Co powders in aqueous media with polyethylenimine", International Journal of Refractory Metals & Hard Materials, 18 (2000), pp. 281-286, and a Doctoral Thesis from the Royal Institute of Technology, Stockholm, Sweden (2004) entitled "Aqueous Processing of WC—Co Powders" by Karin M. Andersson that includes the following articles: Andersson and Bergström, "Oxidation and Dissolution of Tungsten Carbide Powder to Water", *International Journal of Refractory Metals & Hard Materials,* 18, pp. 121-129 (2000); Andersson and Bergstrom, "DI, VO Interactions of Tungsten Oxide and Cobalt Oxide Surfaces Measured with Colloidal Probe Technique", *Journal of Colloid and Interface Science,* 246, pp. 309-315 (2002); Andersson and Bergstrom, "Effect of the Cobalt Ion and Polyethyleneimine Adsorption on the Surface Forces between Tungsten Oxide and Cobalt Oxide in Aqueous Media", *Journal of the American Ceramic Society,* 85, [10], pp. 2404-2408 (2002); Laarz, Jonsson and Andersson, "The Effect of Dispersant Addition and Binder Content on the Properties of Spray-Dried WC—Co Granules", manuscript in preparation; Andersson and Bergström, "Density Measurements of Single Granules using the Atomic Force Microscope", submitted to the *Journal of the American Ceramic Society*; and Andersson and Bergström, "Friction and Adhesion of Single Spray-Dried Granules containing a Hygroscopic Polymeric Binder, submitted to *Powder Technology.*

One exemplary patent document is U.S. Pat. No. 3,846,126 to Foley et al. (filed on Jan. 15, 1973), which discloses the use of water as the solvent and polyvinyl alcohol as the binder. The Foley et al. patent discloses the use of other binders at Col. 3, lines 53-62 wherein these binders include camphor, methyl alcohol, paradichlorobenzene, chloroacetic acid, naphthalene, benzoic acid, phthalic anhydride, glycerine, Acrowax C, ethylene oxide polymers sold as Carbowax, and synthetic gums such as acrylamide and metal stearates. In Foley et al. water is the preferred vehicle for milling unless an increase in oxygen content is a concern in which case use of a solvent is taught. When the oxygen content is critical, use of a solvent is the suggested component. Other patent documents are identified and discussed hereinafter.

U.S. Pat. No. 4,070,184 to Scheithauer et al. has as a focus the use of a water soluble relatively long chain polyglycol additive. The Scheithauer et al. patent sets out the basic differences between itself and the then prior art at Col. 3, lines 37-45:

> The present invention is an improvement over the most modern practice used today for preparing carbide grade powders. It involves three basic and radical departures from the common practice.
>
> 1. The use of water as a milling fluid as opposed to flammable organics.
> 2. The use of an open-cycle spray-drying system as opposed to closed system.
> 3. The use of water soluble, long-chain polyvinyl alcohol as a mixing aid instead of paraffin wax. The basic advantages of the process of this invention are cost, safety, flexibility of operation, and product improvement.

The Scheithauer et al. patent describes the spray drying process at Col. 5, lines 36-46:

> Next the slurry is transferred to the spray dryer feed tank. It is heated, to about 50° C., and agitated while the Carbowax 6000 addition is made. This addition is generally 1-3%. For this grade it is preferably 2%. At this point the spray drying process begins. A suitable spray drier is a Proctor-Schwartz spray tower with two-fluid top-nozzle atomization. Some of the important drying parameters are air pressure of 20 psi, an inlet drying temperature of 200°-230° C. and an outlet temperature of 100°-130° C.

Another patent that discloses the use of water in the milling of hard materials include U.S. Pat. No. 4,397,889 to Benjamin et al. (filed Apr. 5, 1982). U.S. Pat. No. 4,478,888 to Benjamin et al. discloses spray drying at [Col. 4, lines 33-54]:

> Spray drying may be carried out using commercially available spray drying equipment. The inlet and outlet air temperatures should be maintained below about 370° C. and 190° C., respectively, to prevent substantial oxidation or decarburization of the slurry constituents. The spray drying is carried out under conditions to produce an agglomerated powder mixture consisting essentially of aglomerated particles of metal carbide, metal binder and wax. Typically the size range of the agglomerated particles is from about 20 to about 150 microns. During spray drying, the slurry is generally heated to about 50° C. and agitated. A suitable spray dryer is a Protco-Schwartz spray dryer with two-fluid-top nozzle atomization. When water is the milling fluid, typical drying parameters may be an air pressure of 20 psi, drying temperature of 200°-230° C. and an outlet temperature of 100°-130° C. When organic solvents are used as the milling fluid, the spray drying is preferably performed in absent air. Spray drying temperatures are dependent on the volatility of the solvent. The spray dried agglomerates may be classified by screening to obtain a desired fraction.

U.S. Pat. No. 4,886,638 to Penkunas et al. mentions the use of water in the slurry used to make a hard material. U.S. Pat. No. 4,902,471 to Penkunas et al. discloses a slurry with an organic additive (see Col. 3, lines 16-17):

> The organic compound can be an ester of a fatty acid. Some preferred esters are beeswax and carnuba wax.

Some preferred fatty acids are lauric acid, myristic acid, palmitic acid, stearic acid, and combinations thereof.

U.S. Pat. No. 5,007,957 to Penkunas et al. (and U.S. Pat. No. 5,045,277 to Penkunas et al.) mentions using water and an esterfied wax (see Col. 2, lines 24-29):

The first step in forming the grade powder is to combine the binder metal powder with a solid esterified wax to form a first mixture. The preferred waxes are pure beeswax, carnauba wax, candellila wax and combinations of these, although other esterified waxes can be used.

U.S. Pat. No. 5,922,978 to Carroll discloses the use of deoxygenated water as a liquid component of the slurry with a preferred composition is at Col. 4, lines 10-16:

In a most preferred embodiment, the method comprises mixing, in essentially deoxygenated water, WC powder, Co and the organic binder described above. The WC preferably has a submicron particle size. The Co preferably has a submicron particle size. The organic binder is preferably a paraffin wax. More preferably the organic binder is a paraffin wax provided as an emulsion in water.

The Carrol '978 patent also mentions triethanolamine as a corrosion inhibitor (Col. 4, lines 17-28):

Depending on the first powder and additional component, a corrosion inhibitor, such as those known in the art (e.g., corrosion inhibitors useful in the boiler, machining and heat exchanger art), may be used. If added, the corrosion inhibitor should be one that does not, for example, hinder the densification of a part pressed from the pressable powder. Preferably the corrosion inhibitor does not contain an alkali metal, alkaline earth metal, halogen, sulfur or phosphorous. Examples of corrosion inhibitors include those described in U.S. Pat. Nos. 3,425,954; 3,985,503; 4,202,796; 5,316,573; 4,184,991; 3,895,170 and 4,315,889. Preferred corrosion inhibitors include benzotriazole and triethanolamine.

U.S. Pat. No. 6,245,288 to Carroll also uses deoxygenated water to avoid oxygen pickup, and also discloses spray drying is the preferred drying method. See Col. 4, lines 60-64.

European Patent Application 1 440 956 A1 to Kruse (Seco Tools AB) has as a focus on using polyethylimine-based polyelectrpolyte in water and/or alcohol. In general, the Kruse patent application discloses a method of making cemented carbide bodies based on tungsten carbide and with a binder phase based on Co or combinations of Co, Ni, and Fe, or Ni and Fe by powder metallurgical methods including wet milling in alcohol or water or a mixture thereof, of powder and pressing agent to form a slurry, drying the slurry to form a granulate by spray drying, pressing the granulate to form bodies of desired shape and dimension and finally sintering.

U.S. Pat. No. 6,852,274 to Knuinz et al., as well as its European counterpart European Patent No. 1 373 586 B1, disclose a spray drying process that comprises steps of: forming a sprayable slurry of hard material and metallic binder and water and spraying the slurry without the aid of a water-soluble long chain polyglycol. The parameters for the sprayable slurry are: a sprayable slurry with water as a liquid phase and having a solid particle concentration within a range of 65-85% by weight. The parameters of the spray drying are: a gas inlet temperature of substantially 160° to 220° C. and a gas exit temperature in a range of substantially 85° to 130° C., and a ratio of water added with the slurry, in liters per hour, to a tower volume of the spray tower, in $m^3$, lies between 0.5 and 1.8 and such that a maximum of 0.17 kg of slurry is atomized per $m^3$ of incoming drying gas. U.S. Pat. No. 6,733,562 to Knünz et al., which has a European counterpart as European Patent No. 1 373 585 B2, discloses a process that calls for the formation of a slurry of a hard material and metal binder and water wherein after formation of the slurry, the process requires the formation of an emulsion of a non-water soluble pressing aid and an emulsifier and water, which is then mixed with the slurry.

U.S. Pat. No. 6,656,976 to Bergstrom et al., which has European counterpart European Patent No. 1 153 652 B1, pertains to a well-dispersed slurry of mixture of WC-based and Co-based particles and water wherein one feature is the further component of a dispersant comprising 0.1-10 wt % of a polyethylenimine-based polyelectrolyte. U.S. Pat. No. 7,387,658 to Grearson et al., which has European counterpart European Patent 1 739 197 B1, discloses using water as the liquid medium along with about 1 to about 3 wt-% of a pressing agent of equal to or less than about 90 wt-% PEG [polyethylene glycol] and equal to or greater than about 10 wt-% of long chain C≥20 fatty acids, their esters and salts. U.S. Pat. No. 6,878,182 to Kruse discloses a method that includes wet milling in water the powders and pressing agent wherein the slurry is formulated to contain 0.02-0.06 wt % of a polyethylenimine-based polyelectrolyte to the cemented carbide slurry containing WC and Co.

U.S. Pat. No. 7,539,637 B2 to Jutterström et al. pertains to a method of making an agglomerated cemented carbide powder that includes wet milling, preferably in a milling liquid comprising water and/or alcohol or a mixture of water and acetone, a powder mixture containing hard constituent powder(s) and a metallic binder and pressing agents and spray drying the slurry. Before milling, from about 0.05 to about 0.50 wt-% of a complex forming and/or pH-decreasing/increasing additive such as triethanolamine, hydroxides or acids, for example, and a thickener in an amount of thickener from about 0.01 to about 0.10 wt-% is added.

U.S. Pat. No. 7,666,349 B2 to Laarz et al. (European Patent No. 1 806 175 B1 is a counterpart) concerns a method of gel-casting a cemented carbide body. One step in the method is forming an aqueous slurry of WC—Co. The text at Col. 4, lines 22-27 presents a general description:

More specifically, the method according to the present invention comprises the forming of a slurry including WC—Co cemented carbide powder and dispersant in an aqueous medium, to which is added a monofunctional monomer, a cross-linker and a suitable initiator for the system.

More details about the method are set forth at Col. 4, lines 28-61.

U.S. Pat. No. 7,285,241 B2 to Puide concerns injection molding or extruding a hard material component. One step in the process is wet milling the raw materials in water, alcohol or a combination thereof, preferably 80 wt % ethanol, and 20 wt % water, together with the ethylene oxide polymer. More details are set forth at Col. 2, line 55 through Col. 3, line 2.

U.S. Pat. No. 7,303,722 B2 to Bruhn et al. discloses a method to make a hard metal article using powder injection molding or an extrusion method. The method includes a step of wet milling in water or alcohol or a combination of water and alcohol, and the drying the slurry. The text at Col. 3, lines 3-7 provides a basic description of the wet milling:

1. Wet milling of the raw materials in water, or alcohol, or a combination thereof, preferably 80 wt % ethanol and 20 wt % water, together with 0.4-0.8 wt %, preferably 0.5-0.7 wt % stearic acid as a granulating agent for the subsequent spray drying.

U.S. Pat. No. 6,363,951 B1 to Qvick et al. discloses a method of making submicron tungsten carbide tool inserts. The method includes wet milling using ethylalcohol and water as a milling liquid. See Col. 2, lines 23-35.

PCT Publication WO98/00256 to Sandvik AB concerns a method of spray drying powder mixtures that includes spray drying cemented carbide slurries consisting of cemented carbide powder containing hard constituents in an alcohol-water solution. The text at page 3, line 31 through page 4, line 28 describes the slurry.

European Patent No. 0 963 454 B1 to Sandvik Akiebolag concerns a method of making cemented carbide by powder injection molding. According to this patent, the use of a surfactant in the milling step of the cemented carbide provides for a reduction in the level of the porosity in the sintered part. The surfactant can be a single fatty acid like hexadecanoic acid, tetradecanoic acid, 9,10 Octadecanoic acid, 9,12 Octadienoic acid or 9,12,5 Octadecatrienoic acid mixed with the powder in ethanol, acetone, benzene. Furthermore the surfactant can be some kind of organometallic compound, Zn-stearate, or corresponding alcohol to a fatty acid such as 1-hexadecanol. It can also be an amine such as octadecylamine. All these surfactants can be milled in ethanol. Paragraphs [0011] through [0015] provide more details about the method.

U.S. Pat. No. 7,531,022 to Quirmbach et al., which has European counterpart European Patent No. 1 666 616 B1, discloses a method of using a liquid in the preparation of powder mixtures on the basis of hard metals. The method comprises the steps of: (a) providing a milling liquid comprised of water and an inhibitor wherein the inhibitor being a polyvinyllactam or a mixture of a polyvinyllactam and a wax emulsion; (b) providing a powdered metal comprised of at least one hard metal; (c) combining said liquid with said powdered metal in an attritor to form a moist powder mixture; and (d) atomizing said moist powder mixture in a spray drying installation to produce a powder mixture.

United States Published Patent No. US2007/0259970 A1 to Boden et al. pertains to a method for dispersing and passivating particulate powders in water and aqueous media. Water-soluble polyvinylamines and/or the initial products thereof, such as, e.g., polyvinyl formamides, are used for dispersing particulate powders in water and/or aqueous media and furthermore for passivating non-oxidic particulate powders in water.

While the above documents show that others have used water as a milling medium for the milling of hard materials, there remain drawbacks to the use of water as a milling medium for hard materials such as, for example, cemented (cobalt) tungsten carbide. These drawbacks include the oxygen pick up of the hard material components of the aqueous slurry, the excessive sedimentation and excessive segregation of the hard material components of the aqueous slurry, and the lack of a homogeneous dispersion in the hard material aqueous slurry of the additives that facilitate the pressing of the resultant hard material powder. Addressing some of the above drawbacks, especially the excessive sedimentation and excessive segregation of the hard material components of the aqueous slurry and the lack of a homogeneous dispersion in the hard material aqueous slurry of the additives that facilitate the pressing of the resultant hard material powder, results in a reduction in the compaction pressure of the resultant hard material powder. A reduction in the compaction pressure avoids cracks, pits or any other compaction defects in the green parts.

Therefore, it would be highly desirable to provide a hard material such as, for example, a cemented (cobalt) tungsten carbide, and a method of making such cemented (cobalt) tungsten carbide from an aqueous hard material milling slurry wherein the slurry contains one or more additives and the oxygen pick up by the hard material is minimized. Further, it would be highly desirable to provide a hard material such as, for example, a cemented (cobalt) tungsten carbide, and a method of making such cemented (cobalt) tungsten carbide from an aqueous hard material milling slurry wherein the components of the slurry do not experience excessive sedimentation or excessive segregation so as to result in the reduction of the compaction pressure of the resultant hard material powder which helps avoid cracks, pits or any other compaction defects in the green parts. It would also be highly desirable to provide a hard material such as, for example, a cemented (cobalt) tungsten carbide, and a method of making such cemented (cobalt) tungsten carbide from an aqueous hard material milling slurry wherein there is a homogeneous dispersion of the additives useful to facilitate the pressing of the resultant hard material powder so as to result in the reduction of the compaction pressure of the resultant hard material powder which helps avoid cracks, pits or any other compaction defects in the green parts.

SUMMARY

In one form thereof, the invention is an aqueous emulsion for use in aqueous milling of hard material powder components in an aqueous slurry. The aqueous emulsion comprises an oxidation inhibitor in an amount between about 0.6 weight percent and about 1.4 weight percent of the hard material powder components in the aqueous slurry; a paraffin wax in an amount up to about 2.75 weight percent of the hard material powder components in the aqueous slurry; myristic acid in an amount between about 0.10 weight percent and about 0.50 weight percent of the hard material powder components in the aqueous slurry; and the balance being water.

In yet another form thereof, the invention is a method of making an aqueous emulsion for use in milling an aqueous slurry of hard material powder components, the method comprising the following steps: mixing together under heating an oxidation inhibitor in an amount between about 0.6 weight percent and about 1.4 weight percent of the hard material powder components in the aqueous slurry and water to form an oxidation inhibitor-water mixture; melting paraffin wax in an amount up to about 2.75 weight percent of the hard material powder components in the aqueous slurry and myristic acid in an amount between about 0.10 weight percent and about 0.50 weight percent of the hard material powder components in the aqueous slurry to form a paraffin wax-myristic acid solution; adding the oxidation inhibitor-water mixture into the paraffin wax-myristic acid solution to form a pre-blended emulsion; and blending the pre-blended emulsion to form the aqueous emulsion.

In still another form thereof, the invention is a method of making an aqueous slurry of hard material powder components, the method comprising the steps of: mixing together under heating an oxidation inhibitor in an amount between about 0.6 weight percent and about 1.4 weight percent of the hard material powder components in the aqueous slurry and water to form an oxidation inhibitor-water mixture; melting paraffin wax in an amount up to about 2.75 weight percent of the hard material powder components in the aqueous slurry and myristic acid in an amount between about 0.10 weight percent and about 0.50 weight percent of the hard material powder components in the aqueous slurry to form a paraffin wax-myristic acid solution; adding the oxidation inhibitor-water mixture into the paraffin wax-myristic acid solution to form a pre-blended emulsion; blending the pre-blended emulsion to form the aqueous emulsion; combining the aqueous emulsion and hard material powder components wherein the hard material powder components comprising hard carbide powder and metallic binder powder; adding water to the combination of the aqueous emulsion and hard material powder components to form a slurry; and milling the slurry for a pre-selected time to from a milled slurry.

In yet another form thereof, the invention is a method of making a hard material powder from hard material powder components, the method comprising the steps of: mixing together under heating an oxidation inhibitor in an amount between about 0.6 weight percent and about 1.4 weight percent of the hard material powder components and water to form an oxidation inhibitor-water mixture; melting paraffin wax in an amount up to about 2.75 weight percent of the hard material powder components and myristic acid in an amount between about 0.10 weight percent and about 0.50 weight percent of the hard material powder components to form a paraffin wax-myristic acid solution; adding the oxidation inhibitor-water mixture into the paraffin wax-myristic acid solution to form a pre-blended emulsion; blending the pre-blended emulsion to form the aqueous emulsion; combining the aqueous emulsion and hard material powder components wherein the hard material powder components comprising hard carbide powder and metallic binder powder; adding water to the combination of the aqueous emulsion and hard material powder components to form a slurry; milling the slurry for a pre-selected time to from a milled slurry; and drying the milled slurry to form the hard material powder wherein the drying is selected from the group comprising vacuum drying and spray drying.

In another form thereof, the invention is a method of making a hard material article from hard material powder components, the method comprising the steps of: mixing together under heating an oxidation inhibitor in an amount between about 0.6 weight percent and about 1.4 weight percent of the hard material powder components and water to form an oxidation inhibitor-water mixture; melting paraffin wax in an amount up to about 2.75 weight percent of the hard material powder components and myristic acid in an amount between about 0.10 weight percent and about 0.50 weight percent of the hard material powder components to form a paraffin wax-myristic acid solution; adding the oxidation inhibitor-water mixture into the paraffin wax-myristic acid solution to form a pre-blended emulsion; blending the pre-blended emulsion to form the aqueous emulsion; combining the aqueous emulsion and hard material powder components wherein the hard material powder components comprising hard carbide powder and metallic binder powder; adding water to the combination of the aqueous emulsion and hard material powder components to form a slurry; milling the slurry for a pre-selected time to from a milled slurry; drying the milled slurry to form the hard material powder wherein the drying is selected from the group comprising vacuum drying and spray drying; and consolidating the hard material powder to form the hard material article.

BRIEF DESCRIPTION OF THE DRAWINGS

The following is a brief description of the drawings that form a part of this patent application.

DETAILED DESCRIPTION

Figure 1:
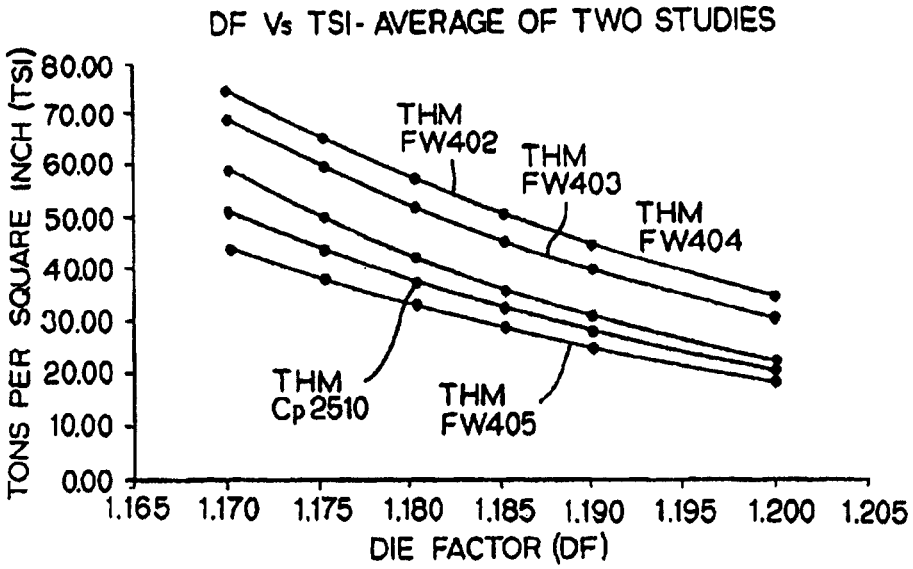
FIG. 1 is a plot of the die factor (DF) vs. pressing pressure in tons per square inch (tsi) for the THM powder grade produced by differing methods of production.

The present invention pertains to a hard material and a method of making the hard material from an aqueous slurry of hard material powder components (e.g., carbide and metallic binder). More specifically, the present invention pertains to a hard material such as, for example, a cemented (cobalt) tungsten carbide, and a method of making such cemented (cobalt) tungsten carbide from an aqueous slurry of hard material powder components (e.g., carbide and metallic binder) wherein the slurry contains one or more additives. The hard material possesses properties that meet or exceed those properties of hard materials formed from a solvent-based hard material slurry.

In the present invention, the hard material powders comprise cemented tungsten carbide grades wherein the binder is either cobalt alone or a combination of cobalt and nickel and chromium. Table A below sets forth the specific compositions of these hard material grades and the grain size of the sintered material. The average grain size (in

TABLE A

Specific Compositions of Cemented Tungsten Carbide Powder Grades

| Grade | Tungsten Carbide (weight percent) | Cobalt or Cobalt + Nickel + Chromium (weight percent) | Sintered Average Grain Size (micrometers [μm]) |
|---|---|---|---|
| THM | Balance (93.9 wt %) | 6.1 wt % cobalt only | 1.2-1.8 μm |
| GT30 | Balance (85.0 wt %) | 15.0 wt % cobalt only | 2.5-4.5 μm |
| BN45 | Balance (88 wt %) | cobalt + nickel + chromium equal to 12 wt %. | 3.0-6.0 μm |
| BN55 | Balance (85 wt %) | cobalt + nickel + chromium equal to 15 wt % | 3.0-6.0 μm |
| BN65 | Balance (80 wt %) | cobalt + nickel + chromium equal to 20 wt % | 3.0-6.0 μm |

micrometers (μm)) is measured using the Lineal Intercept Method as set forth in ASTM E112-10 Standard. In the compositions using cobalt and nickel and chromium, the cobalt and nickel are the dominant elements and the chromium is present in a lesser amount.

The process to make the cemented tungsten carbide hard material powder comprises two fundamental parts. The first part is the formation of the aqueous slurry which contains the components of the cemented tungsten carbide hard material powder. The second part comprises the drying of the aqueous slurry via either vacuum drying or spray drying to form the cemented tungsten carbide hard material powder. As an alternative, the hard material powder can be re-worked in an aqueous slurry using DM water only or DM water with anti-oxidant (e.g., METAMAX 1-15) as the milling liquid. As used herein, the term "DM water" means de-mineralized water or de-ionized water. The re-worked aqueous slurry can be spray dried to form the re-worked hard material powder.

Referring to the formation of the aqueous slurry that contains the components of the cemented tungsten carbide hard material powder, the basic steps of the process comprise the following. The first basic step is the formation of the wax emulsion that comprises the following components: METAMAX 1-15 and myristic acid and IGI wax and DM water. As one alternative, triethanolamine (TEA) can be used instead of the METAMAX 1-15 as an oxidation inhibitor (or anti-oxidant). Further, hexamine can be used instead METAMAX 1-15 an alternate anti-oxidant or oxidation inhibitor. The scientific names for hexamine are hexamethylenetetramine, methenamine, and aminoform.

In reference to the specific properties and characteristics of these components, METAMAX 1-15 is a preparation of amines in aqueous solution that has the following characteristics: appearance: clear-turbid, colorless liquid; solubility in water is unrestrictedly soluble in water; density is approximately 1.05 grams per cubic centimeter (gm/cm$^3$), and the water content is approximately 88 percent. METAMAX 1-15 can debinded at temperature between about 200° C. and about 450° C. METAMAX 1-15 functions to reduce the oxygen absorption of hard metal components in the aqueous slurry. METAMAX 1-15 is described in a brochure entitled "Oxidation inhibitor for aqueous preparation of hard metals" by Zschimmer & Schwarz GmbH Co. KG, and is sold by Zschimmer & Schwarz GmbH Co. KG, Max-Scharz-Strafle 3-5, 56112, Lahnstein, Germany under the designation METAMAX 1-15.

Myristic acid has an IUPAC name of tetradecanoic acid and is a saturated 14 carbon fatty acid with the formula $C_{14}H_{28}O_2$ and a molecular weight equal to 228.37092. In the specific examples set forth herein, the source of the myristic acid is Merck and Co. or Sigma-Aldrich Co. LLC and it is available under the name myristic acid. The myristic acid performs the function of surfactant.

IGI wax is fully refined paraffin wax sold by The International Group, Inc., of USA. The specific IGI wax is IGI Wax-1236. The IGI Wax-1236 has a melting point equal to about 55.6° C. As mentioned above, the DM water is de-mineralized or de-ionized water.

The triethanolamine (TEA) has an IUPAC name of 2-[bis(2-hydroxyethyl)amino]ethanol. It has the molecular formula: $C_6H_{15}NO_3$ and a molecular weight equal to 149.1882.

The first step in the preparation of the wax emulsion is to mix together the METAMAX 1-15 (oxidation inhibitor) and DM water. The METAMAX 1-15 is in a liquid form wherein the mixture of METAMAX 1-15 and DM water is heated until it is warm, which is a temperature between about 50° C. and about 60° C. The IGI wax (paraffin wax), which is in a solid form, and myristic acid, which is in a solid form, are heated until they melt. Once the solution of the METAMAX 1-15 and DM water has reached the above temperature, the METAMAX 1-15-DM water solution and the IGI wax-myristic acid (melted) solution are added together. Here, it is important to note that the METAMAX 1-15-DM water solution is added to the IGI wax-myristic acid (melted) solution and not the reverse wherein the IGI wax-myristic acid (melted) solution is added to the METAMAX 1-15-DM water solution. It has been found that the reverse process of adding IGI wax-myristic acid (melted) solution is added to the METAMAX 1-15-DM water solution has not resulted in the successful formation of emulsion. Thus, the sequence of adding the components to form the emulsion is important to the successful formation of the emulsion. Once all of the METAMAX 1-15-DM water solution has been added to the IGI wax-myristic acid solution the emulsion is blended using a high speed blender. The balance of the DM water is then added to the blended emulsion depending upon the specific application in which the wax emulsion will be used.

Table B below sets forth the specific compositions of the wax emulsion for use in either an attritor mill or a ball mill.

TABLE B

Exemplary Composition for Wax Emulsions for Attritor Mill and Ball Mill Using 1 kilogram (kg) of Hard Material Powder Components

| Additive Type | Available Form of the Additive | Water and Additives Concentration (%) | Water and Additives Concentration in Grams per 1 kilogram of Hard Material Powder Components |
|---|---|---|---|
| METAMAX I-15 (grams) | liquid | 1.00 wt % on a powder basis | 10.0 grams per 1 kg of hard material powder components |
| Myristic Acid (grams) | solid | 0.15 wt % on a powder basis | 1.5 grams per 1 kg of hard material powder components |
| IGI Wax | solid | 0.50 wt % on a | 5.0 grams per 1 kg of |

TABLE B-continued

Exemplary Composition for Wax Emulsions for Attritor Mill and Ball Mill Using 1 kilogram (kg) of Hard Material Powder Components

| Additive Type | Available Form of the Additive | Water and Additives Concentration (%) | Water and Additives Concentration in Grams per 1 kilogram of Hard Material Powder Components |
|---|---|---|---|
| (grams) | | powder basis | hard material powder components |
| Water (liters) when using ball mill | liquid | 50 wt % on a powder basis when using ball mill | 0.5 liters per 1 kg of hard material powder components |
| Water (liters) when using attritor mill | liquid | 21 to 25 wt % on a powder basis when using attritor mill | 0.21 liters [does not include top-up water added at beginning of the milling] 1 kg of hard material powder components |

TABLE C

Exemplary Composition for Wax Emulsions for Attritor Mill Using 250 kilogram (kg) of Hard Material Powder Components

| Additive Type | Available Form of the Additive | Water and Additives Concentration (%) | Water and Additives Concentration in Grams per 250 kilogram of Hard Material Powder Components |
|---|---|---|---|
| METAMAX I-15 (grams) | liquid | 1.00 wt % on a powder basis | 2.5 kilograms (kg) per 250 kg of hard material powder components |
| Myristic Acid (grams) | solid | 0.15 wt % on a powder basis | 375 grams per 250 kg of hard material powder components |
| IGI Wax (grams) | solid | 0.50 wt % on a powder basis | 1.25 kilograms (kg) per 250 kg of hard material powder components |
| Water (liters) when using attritor mill | liquid | 21 wt % to 25 wt % on a powder basis when using attritor mill | 52.5 liters [does not include top-up water added at beginning of the milling] 250 kg of hard material powder components |

Referring to Table B and Table C, the term "on a powder basis" means the weight of the hard material components wherein these hard material powder components comprise the carbide powder(s) and the binder alloy powder(s).

Still referring to the formation of the aqueous slurry, DM water (e.g., about 80 percent of the full DM water content) is first loaded into the attritor mill or the ball mill. The wax emulsion is then loaded into the attritor mill or the ball mill. The attritor mill or the ball mill is started and the hard material components (e.g., powders) are loaded into the attritor mill or the ball mill. DM water is loaded into the powders or the stirrers or the balls are covered wherein the DM water is added to reach a pre-selected volume. The slurry is milled for a pre-selected time, after which the slurry is unloaded via a discharge pump and subjected to wet sieving.

The sieved slurry is then processed by a spray dryer or a vacuum dryer to result in the finished hard material (e.g., cemented tungsten carbide) powder. For the specific processes, one of three different vacuum dryers was used to dry the slurry. Vacuum Dryer No. 1 (Nauta Dryer) is a vacuum dryer that can dry 50 kilograms (kg) of carbide powder in slurry form in one charge. The typical drying parameters are: temperature in the range of about 130° C. to about 140° C.; vacuum equal to about 1 Torr; the duration of the heating and dwelling time equals between about 6 hours and about 8 hours; and a stirrer speed equal to about 20 revolutions per minute (RPM).

Vacuum Dryer No. 2 (IKA Dryer) is a table top laboratory rotary vacuum dryer manufactured by IKA that can dry up to 500 grams (gm) of carbide powder in slurry form in one charge. The typical drying parameters are: temperature in the range of about 160° C. to about 170° C.; vacuum equal to about 0.5 Torr; the duration of the heating and dwelling time equals about 4 hours; and the flask rotation equals between about 20 RPM and about 40 RPM.

Vacuum Dryer No. 3 (Ross Dryer) is a vacuum dryer that can dry 250 kilograms (kg) of carbide powder in slurry form in one charge. The typical drying parameters are: temperature in the range of about 125° C. to about 135° C.; vacuum equal to greater than about −550 mm Hg; the duration of the heating and dwelling time equals between about 10 hours and about 12 hours; and a stirrer speed equal to between about 20 RPM and about 40 RPM.

Referring to the sintering of the hard material powder, Table D sets forth the sintering and/or sinter-HIPping parameters.

TABLE D

Sintering and/or Sinter-HIPping Parameters

| Grade | Sintering Temperature (° C.) | Sintering Dwell Time (hours) | Hipping (temperature and pressure) |
|---|---|---|---|
| THM | 1470-1500° C. | 1 hr | No |
| GT30 | 1390-1430° C. | 1 hr | No |
| BN45 | 1390-1430° C. | 1 hr | At 1330-1340° C. & 1150-1250 bar |
| BN55 | 1390-1430° C. | 1 hr | At 1330-1340° C. & 1150-1250 bar |
| BN65 | 1390-1430° C. | 1 hr | At 1330-1340° C. & 1150-1250 bar |

Table D sets forth the sintering temperature in a range as measured in degrees Centigrade (° C.), the time at the sintering temperature in hours, and the hot isostatic pressing parameters of temperature (° C.) and pressure in bar.

Specific batches of hard material were processed using an aqueous slurry wherein the aqueous slurry was subjected to drying so as to result in a hard material powder. The hard material powder was consolidated (i.e., sintered or sinter-HIPped) to result in a final article. Table E through Table I set forth the compositions of the different batches.

TABLE E

Compositions of Emulsions for the THM Powder Grade

| Batch No. | Powder Grade | Components of the Additives | Drying Type |
|---|---|---|---|
| Cp2510 | THM | Not applicable since used acetone milling and not an aqueous slurry | |
| FW402 | THM | 1 vol % TEA + 0.5 wt % IGI wax + balance DM water (all are added individually) | Nauta Dryer |
| FW403 | THM | 1 vol % TEA + 0.5 wt % IGI wax + balance DM water (all are added individually) | Nauta Dryer |
| FW404 | THM | 1 vol % METAMAX I-15 + balance | IKA |

TABLE E-continued

| Compositions of Emulsions for the THM Powder Grade | | | |
|---|---|---|---|
| Batch No. | Powder Grade | Components of the Additives | Drying Type |
| | | DM water (all are added individually) | Dryer |
| FW405 | THM | 1 vol % TEA + 0.5 wt % IGI wax + 0.45 wt % myristic acid + balance DM water (they are used in Emulsion form) | IKA Dryer |

In Table E through and including Table I, the statement that "all are added individually" means that the components are added individually into the mill and the term "they are used in emulsion form" means that the TEA-DM water solution is added to the IGI wax-myristic acid (melted) solution to form an emulsion or that the METAMAX 1-15-DM water solution is added to the IGI wax-myristic acid (melted) solution to form an emulsion, depending upon the specific components.

For Table E, the composition of the additive components when in volume percent references a volume percent of the amount of water present in the entire aqueous milling slurry, and the weight percent references a weight percent of the content of the hard material powder components comprise the carbide powder(s) (i.e., tungsten carbide) and the binder alloy powder(s) (i.e., cobalt).

TABLE F

| Properties of Slurries of GT30 Powder Grade | | | |
|---|---|---|---|
| Batch No. | Powder Grade | Components of the Additives | Drying |
| F + Cp1763 | GT30 | Not applicable since used acetone milling and not an aqueous slurry | |
| F + Cp1769 | GT30 | Not applicable since used acetone milling | |
| FW501 | GT30 | 1 vol % TEA + 0.5 wt % IGI wax + balance DM water (all are added individually) | Nauta Dryer |
| FW502 | GT30 | 1 vol % TEA + 0.5 wt % IGI wax + 0.3 wt % myristic acid + balance DM water (they are used in Emulsion form) | Nauta Dryer |
| FW503 | GT30 | 1 vol % METAMAX I-15 + 0.5 wt % IGI wax + 0.3 wt % myristic acid + balance DM water (they are used in Emulsion form) | Ross Dryer |
| FW503A | GT30 | Re-milling of FW503 with DM water alone | Ross Dryer |

For Table F, the composition of the additive components when in volume percent references a volume percent of the amount of water present in the entire aqueous milling slurry, and the weight percent references a weight percent of the content of the hard material powder components comprise the carbide powder(s) (i.e., tungsten carbide) and the binder alloy powder(s) (i.e., cobalt).

TABLE G

| Properties of Slurries of BN55 Powder Grade | | | |
|---|---|---|---|
| Batch No. | Powder Grade | Components of the Additives | Drying |
| Cp725 | BN55 | Not applicable since used acetone milling and not an aqueous slurry | |
| Cp738 | BN55 | Not applicable since used acetone milling | |
| FW300 | BN55 | 1 vol % TEA + 0.5 wt % IGI wax + balance DM water (all are added individually) | Nauta Dryer |
| FW302 | BN55 | 0.5 wt % METAMAX I-15 + 0.15 wt % Myristic Acid + 0.5 wt % IGI wax + balance water (they are used in Emulsion form) | Ross Dryer |
| FW303 | BN55 | 0.5 wt % METAMAX I-15 + 0.15 wt % Myristic Acid + 0.5 wt % IGI wax + balance water (they are used in Emulsion form) | Ross Dryer |
| FW304 | BN55 | 1.0 wt % METAMAX I-15 + 0.15 wt % Myristic Acid + 0.5 wt % IGI wax + balance water (they are used in Emulsion form) | Ross Dryer |
| FW305 | BN55 | 1.0 wt % METAMAX I-15 + 0.15 wt % Myristic Acid + 0.5 wt % IGI wax + balance water (they are used in Emulsion form) | Ross Dryer |
| FW310 | BN55 | 1.0 wt % METAMAX I-15 + 0.15 wt % Myristic Acid + 0.5 wt % IGI wax + balance water (they are used in Emulsion form) | Ross Dryer |

For Table G, the composition of the additive components when in volume percent references a volume percent of the amount of water present in the entire aqueous milling slurry, and the weight percent references a weight percent of the content of the hard material powder components comprise the carbide powder(s) (i.e., tungsten carbide) and the binder alloy powder(s) (i.e., cobalt and nickel and chromium).

TABLE H

| Properties of Slurries of BN45 Powder Grade | | | |
|---|---|---|---|
| Batch No. | Powder Grade | Components of the Additives | Drying |
| FW202 | BN45 | 1.0 wt % METAMAX I-15 + 0.15 wt % Myristic Acid + 0.5 wt % IGI wax + balance water (they are used in Emulsion form) | Ross Dryer |

For Table H, the composition of the additive components which is weight percent references a weight percent of the content of the hard material powder components comprise the carbide powder(s) (i.e., tungsten carbide) and the binder alloy powder(s) (i.e., cobalt and nickel and chromium).

TABLE I

| Properties of Slurries of BN65 Powder Grade | | | |
|---|---|---|---|
| Batch No. | Powder Grade | Components of the Additives | Drying |
| FW600 | BN65 | 1.0 wt % METAMAX I-15 + 0.15 wt % Myristic Acid + 0.5 wt % IGI wax + balance water (they are used in Emulsion form) | Ross Dryer |

For Table I, the composition of the additive components which is in weight percent references a weight percent of the content of the hard material powder components comprise the carbide powder(s) (i.e., tungsten carbide) and the binder alloy powder(s) (i.e., cobalt and nickel and chromium).

Table J sets forth selected properties of a sintered article made from the GT30 powder grade.

TABLE J

Properties of the Consolidated Articles of the GT30 Powder Grade

| Batch No. (Grade) | Milling Parameters & Consolidation Parameters | Properties of Consolidated Articles |
|---|---|---|
| FW503 (GT30) - SNUN | Ball milling for 28 hours Sintering at 1430° C., Soak time = 1 hour | $H_c$ = 93<br>4πσ = 28.8<br>Sp. Gr. = 13.956<br>Hv30 = — |
| FW503 (GT30) - SNUN | Ball milling for 28 hours Sintering at 1430° C., Soak time = 1 hour | $H_c$ = 92<br>4πσ = 29.0<br>Sp. Gr. = 13.946<br>Hv30 = — |
| FW503 (GT30) - SNUN | Ball milling for 28 hours Sintering at 1430° C., Soak time = 1 hour | $H_c$ = 92<br>4πσ = 28.7<br>Sp. Gr. = —<br>Hv30 = — |
| FW503 (GT30) SNUN | Ball milling for 28 hours Sintering at 1430° C., Soak time = 1 hour | $H_c$ = 92<br>4πσ = 28.9<br>Sp. Gr. = 13.925<br>Hv30 = 1139 |
| FW503 (GT30) CIP Bar | Ball milling for 28 hours Sintering at 1430° C., Soak time = 1 hour | $H_c$ = 91<br>4πσ = 29.8<br>Sp. Gr. = —<br>Hv30 = 1130 |
| FW503A (GT30) SNUN | FW503 powder ball milled in DM water only for 4 hours with Carbon correction and Sintering at 1430° C., Soak time = 1 hour | $H_c$ = 112<br>4πσ = 25.1<br>Sp. Gr. = 14.089<br>Hv30 = — |
| FW 503A (GT30) SNUN | FW503 powder ball milled in DM water only for 4 hours with Carbon correction and Sintering at 1430° C., Soak time = 1 hour | $H_c$ = 112<br>4πσ = 25.0<br>Sp. Gr. = 14.079<br>Hv30 = 1147 |
| FW 503A (GT30) SNUN | FW503 powder ball milled in DM water only for 4 hours with Carbon correction and Sintering at 1430° C., Soak time = 1 hour | $H_c$ = 110<br>4πσ = 25.7<br>Sp. Gr. = 14.063<br>Hv30 = — |
| FW 503A (GT30) SNUN | FW503 powder ball milled in DM water only for 4 hours with Carbon correction and Sintering at 1430° C., Soak time = 1 hour | $H_c$ = 109<br>4πσ = 26.2<br>Sp. Gr. = 14.058<br>Hv30 = 1136 |

In the above Table J, the $H_c$ is the coercive force (HC) as measured in oersteds, the 4πσ is measured in micro-$Tm^3$/kg, the specific gravity (Sp. Gr.) is measured in grams per cubic centimeter, and the Vickers hardness (Hv30) is (which has no units) as measured per the Indentation technique. All the properties for FW503A batch are within the specification range. The powder can be re-milled for carbon correction with only DM water as milling solvent.

Table K sets forth the properties of a sintered article made from the BN45 powder grade wherein the impact of the delay in days between pressing and sintering is evaluated.

TABLE K

Effect of Slurry Delay on the Properties of Consolidated Article in BN45 Grade

| Powder Type | Days of delay: Milling & Drying | Days of Delay: Pressing & Sintering | Consolidating Conditions | Consolidated Properties |
|---|---|---|---|---|
| 6 hours milled Ross Dried | 1 | 5 | 94-PF1-1430, Soak time = 1 hour | $H_c$ = 79<br>4πσ = 10.8<br>Sp. Gr. = 14.308<br>Hv30 = 1084 |

TABLE K-continued

Effect of Slurry Delay on the Properties of Consolidated Article in BN45 Grade

| Powder Type | Days of delay: Milling & Drying | Days of Delay: Pressing & Sintering | Consolidating Conditions | Consolidated Properties |
|---|---|---|---|---|
| 6 hours milled IKA dried | 3 | 19 | 94-PF1-1430, Soak time = 1 hour | $H_c$ = 78<br>4πσ = 10.9<br>Sp. Gr. = 14.310<br>Hv30 = 1073 |
| 6 hours milled IKA dried | 7 | 15 | 101-PF1-1430, Soak time = 1 hour | $H_c$ = 80<br>4πσ = 11.4<br>Sp. Gr. = 14.287<br>Hv30 = 1077 |
| 6 hours milled IKA dried | 13 | 9 | 101-PF1-1430-, Soak time = 1 hour | $H_c$ = 78<br>4πσ = 11.3<br>Sp. Gr. = 14.296<br>Hv30 = 1074 |
| 6 hours milled IKA dried | 16 | 6 | 101-PF1-1430, Soak time = 1 hour | $H_c$ = 78<br>4πσ = 11.5<br>Sp. Gr. = 14.282<br>Hv30 = 1086 |

In the above Table K, the $H_c$ is the coercive force (HC) as measured in oersteds, the 4πσ is measured in micro-$Tm^3$/kg, the specific gravity (Sp. Gr.) is measure din grams per cubic centimeter, and the Vickers hardness (Hv30) which has no units. Table K illustrates that, there is no carbon loss and oxygen pickup (measured in terms of Magnetic Saturation 4πσ) in the BN45 grade powder when the powder is kept in the aqueous slurry with all additives for 16 days.

FIGS. 1, 2, 3, 11, 12 and 14 are plots that include the die factor, which is defined as the ratio of die diameter to sintered diameter of the cylindrical test sample. This is basically a shrinkage along the diameter with respect to die diameter. The plot illustrates the effect of shrinkage on pressing pressure measured as TSI (Tons per Square Inch). This graph also is used to compare the Pressing Pressure between different type of Powders, at a particular Die Factor.

Referring to FIG. 1, for the THM powder grade, at a die factor equal to 1.18, the pressing pressure (TSI) for water milled (aqueous slurry) powder batches (FW402 and FW403 and FW404) was higher than acetone milled powder (Cp2510). For these powders, powder milled with water resulted in higher compaction pressure at same shrinkage. However, the pressing pressure (TSI) for water milled powder batch (FW405) was lower than acetone milled powder (Cp2510) at a die factor of 1.18. These results show that the pressing behavior of water milled powder FW405 is different from that of other water milled powders FW402, FW403, and FW404. It appears that this difference is due to the addition of myristic acid and use of all additives in emulsion form. Further, it is noted that the pressing pressure of powder FW404, which used METAMAX 1-15 rather than TEA, is lower than powders FW402 and FW403. In summary, the pressing pressure was reduced by the use of myristic acid and all additives (i.e., IGI-Wax, Oxidation Inhibitor, Myristic Acid) in emulsion form. It also appears that the use of METAMAX 1-15 instead of TEA resulted in a lower pressing pressure at die factor 1.18. One can look at the relative pressing pressure at other die factors and draw appropriate conclusions.

Figure 2:
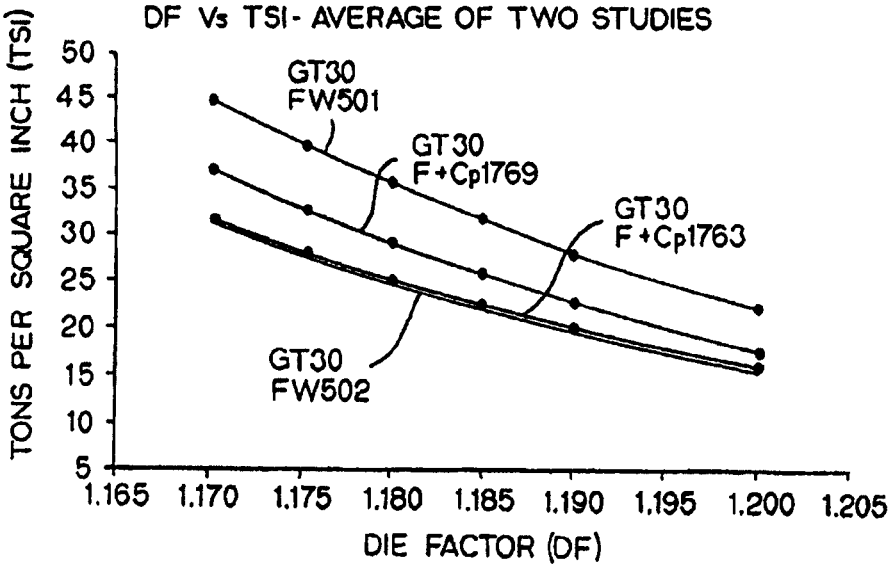
FIG. 2 is a plot of the die factor (DF) vs. pressing pressure in the tons per square inch (tsi) for the GT30 powder grade produced by differing methods of production.
Figure 14:
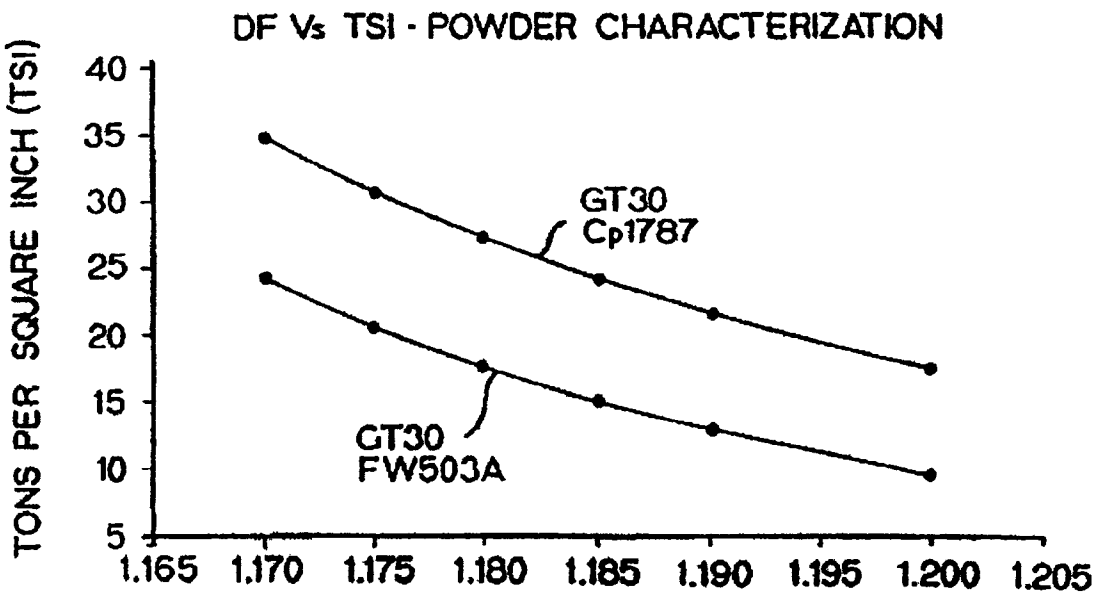
FIG. 14 is a plot of the die factor vs. the pressing pressure in tons per square inch (tsi) for the GT30 powder grade wherein one method used acetone as the milling fluid (Batch No. Cp 1787) and the other method used an aqueous, slurry (Batch No. FW 503A)

Referring to FIG. 2, which pertains to the powder grade GT30, there are two powders (F+Cp1763 and F+Cp1769) that were processed using acetone. At a die factor equal to 1.18, the pressing pressure (TSI) for water milled (aqueous slurry) powder batch FW501 is greater than the pressing pressure for both acetone-processed powders and the other aqueous powder FW502. The pressing pressure (TSI) for one of the water milled powder batches (FW502) is lower than one of the acetone milled powder (F+Cp1769) and equivalent to the other acetone milled powder F+Cp1763. In summary, for the powder FW502, the pressing pressure appears to have been reduced by the use of myristic acid and all additives (i.e., IGI-Wax, Oxidation Inhibitor, Myristic Acid) in emulsion form. It is noteworthy that the one water-milled powder (FW502) has an equivalent pressing pressure as the one acetone-milled powder (F+Cp1763). Referring to FIG. 14, which also pertains to the powder grade GT30, at all of the die factors represented in FIG. 14, the aqueous milled powder batch FW503A exhibited a reduced pressing pressure as compared to an acetone-milled powder batch Cp1787. FW503A included a reworking of the FW503 powder batch by aqueous milling using water only.

Figure 3:
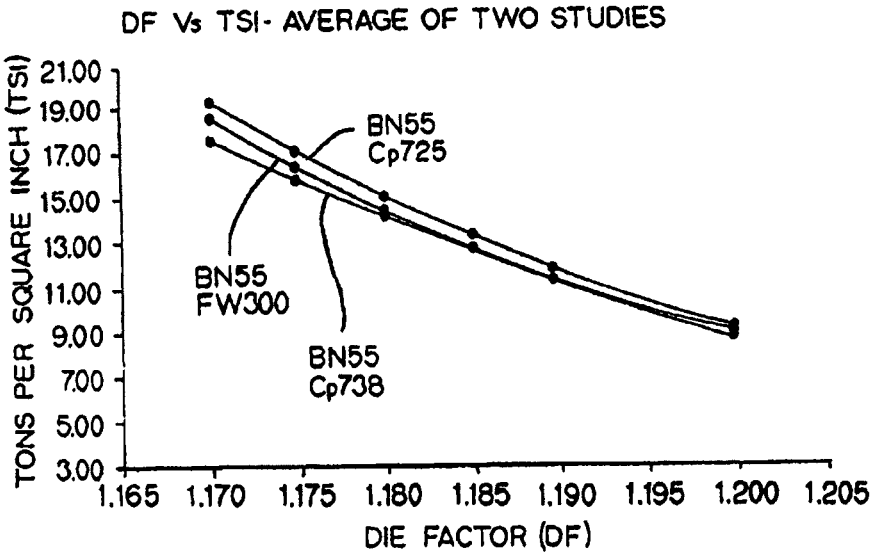
FIG. 3 is a plot of the die factor (DF) vs. pressing pressure in tons per square inch (tsi) for the BN55 powder grade produced by differing methods of production.

Referring to FIG. 3, which concerns the powder grade BN55, at a die factor equal to 1.18, the pressing pressure (TSI) for water milled (aqueous slurry) powder batch (FW300) is higher than one acetone milled powder (Cp738) and lower than a second acetone-milled powder (Cp725). Powder milled with water resulted in higher compaction pressure at same shrinkage as compared to one acetone-milled powder and resulted in a reduced compaction pressure at the same shrinkage as compared to another acetone-milled powder. The behavior of aqueous milled powder is similar to acetone milled powder without the use of Myristic acid and all other additives in emulsion form. The main difference between BN55 grade and previously discussed THM and GT30 grade is the presence of Ni and Cr in the composition of BN55 which could have reduced the oxidation of powder.

Figure 11:
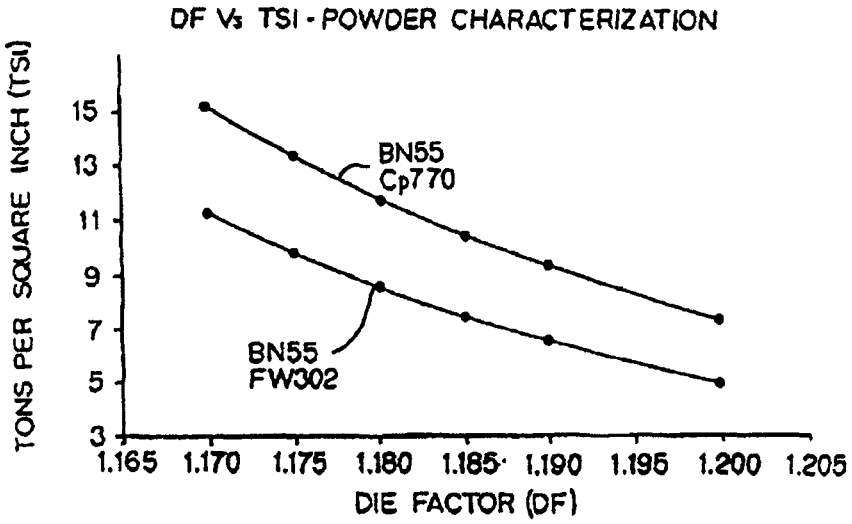
FIG. 11 is a plot of the die factor (DF) vs. pressing pressure in tons per square inch (tsi) for the BN55 powder produced by differing methods of production wherein one method used acetone as the milling fluid (Batch No. Cp 770) and the other method used an aqueous slurry (Batch No. FW 302)
Figure 12:
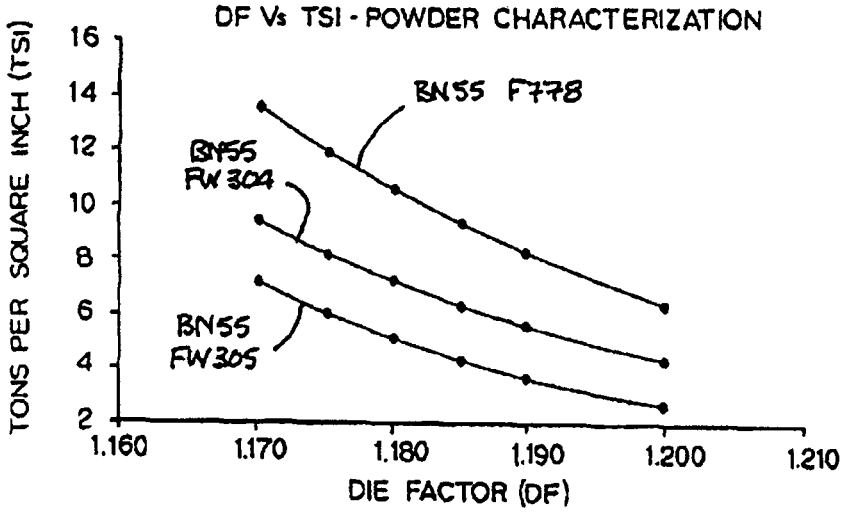
FIG. 12 is a plot of the die factor (DF) vs. pressing pressure in tons per square inch (tsi) for the BN55 powder produced by differing methods of production.

Referring to FIG. 11, at a die factor equal to 1.18, the pressing pressure (TSI) for water milled (aqueous slurry) powder batch (FW302) is lower than acetone milled powder (Cp770) for the Grade BN55. Powder milled with water resulted in a reduced compaction pressure at same shrinkage. In summary, the pressing pressure was reduced by the use of METAMAX 1-15 and all other additives in emulsion form. Referring to FIG. 12 which pertains to the BN55 powder grade, it appears that similar results were achieved using all additives in emulsion form in powder batches FW304 and FW305 as compared to the acetone-milled powder F778. At a die factor equal to 1.18, the aqueous milled powder batches achieved lower pressing pressures than the acetone-milled powder batch. Each one of the powder batches used METAMAX 1-15 and all other additives in the emulsion form.

Figure 4:
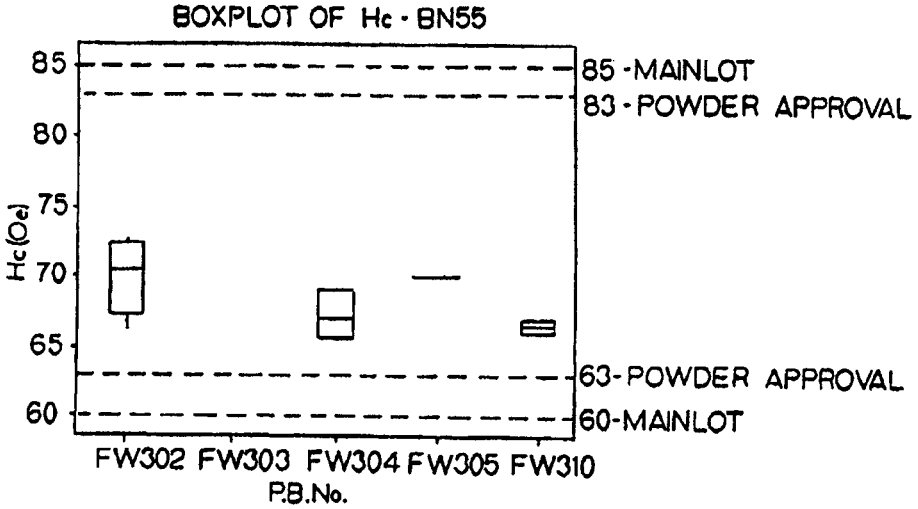
FIG. 4 is a box plot of the coercive force ($H_C$) in oersteds (Oe) for the BN55 powder grade produced by differing methods of production.

FIGS. 4 through 10 pertain to the powder grade BN55 and reflect the testing of various properties for the powder grade. FIGS. 4 through 10 set forth the results of five batches of the BN55 powder grade. FW302 and FW303 compositions were milled in a 50 kilogram batch and FW304, FW305 and FW310 compositions were milled in a 250 kilogram batch. Referring to FIG. 4, coercive force (Hc in Oersteds) for the five batches processed in aqueous media with emulsion, are within the acceptable range. These results therefore show that articles made from batches processed in aqueous media with emulsion exhibit a satisfactory range of this property (i.e., coercive force (He in Oersteds)) so as to thereby demonstrate the effectiveness of using aqueous media as compared to solvent-based milling media.

Figure 5:
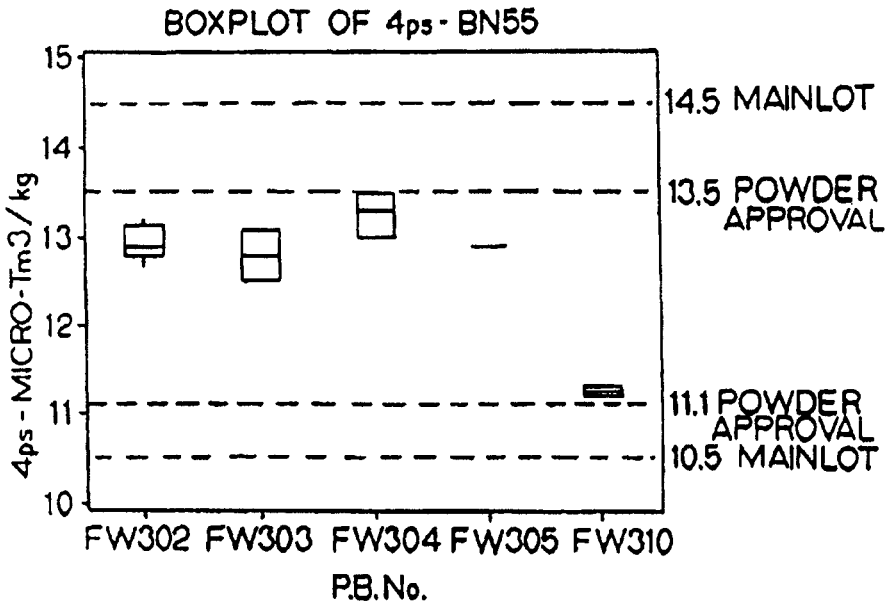
FIG. 5 is a box plot of the $4\pi\sigma$ (micro-$Tm^3$/kg) value for the BN55 powder grade produced by differing methods of production.

Referring to FIG. 5, magnetic saturation ($4\pi\sigma$ in $\mu$-$Tm^3$/kg) for the Five batches processed in aqueous media with emulsion, are within the acceptable range. These results therefore show that articles made from batches processed in aqueous media with emulsion exhibit a satisfactory range of this property (i.e., magnetic saturation) so as to thereby demonstrate the effectiveness of using aqueous media as compared to solvent-based milling media.

Figure 6:
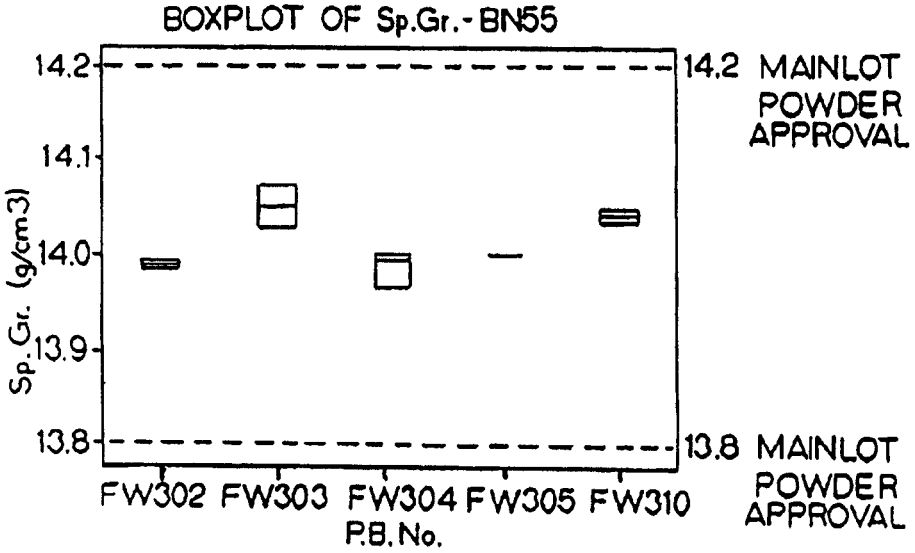
FIG. 6 is a box plot of the specific gravity (grams/cubic centimeter [$gr/cm^3$]) for the BN55 powder grade produced by differing methods of production.

Referring to FIG. 6, specific gravity (Sp.Gr in $g/cm^3$) for the five batches processed in aqueous media with emulsion, are within the acceptable range. These results therefore show that articles made from batches processed in aqueous media with emulsion exhibit a satisfactory range of this property (i.e., specific gravity) so as to thereby demonstrate the effectiveness of using aqueous media as compared to solvent-based milling media.

Figure 7:
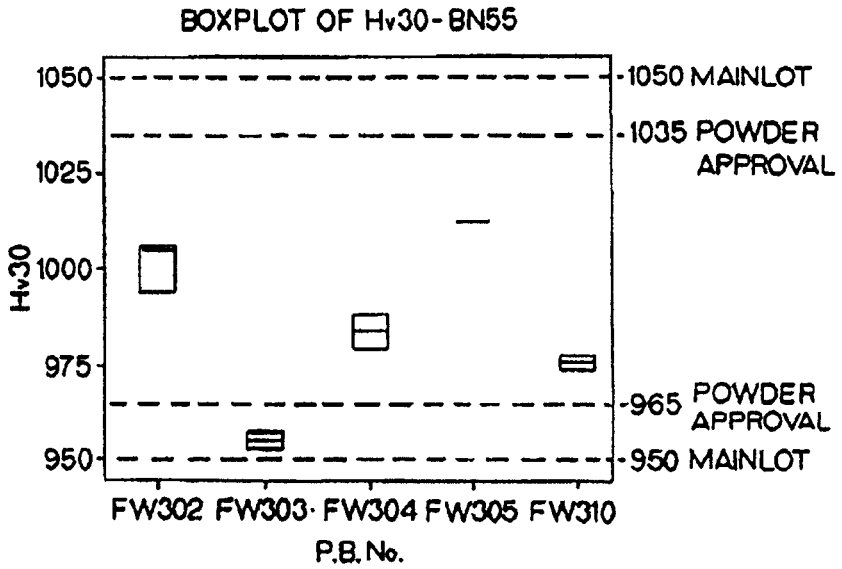
FIG. 7 is a box plot of the Vickers Hardness (Hv30) for the BN55 powder grade produced by differing methods of production.

Referring to FIG. 7, Vickers Hardness (Hv) for the Five batches processed in aqueous media with emulsion, are within the acceptable range. These results therefore show that articles made from batches processed in aqueous media with emulsion exhibit a satisfactory range of this property (i.e., hardness) so as to thereby demonstrate the effectiveness of using aqueous media as compared to solvent-based milling media.

Figure 8:
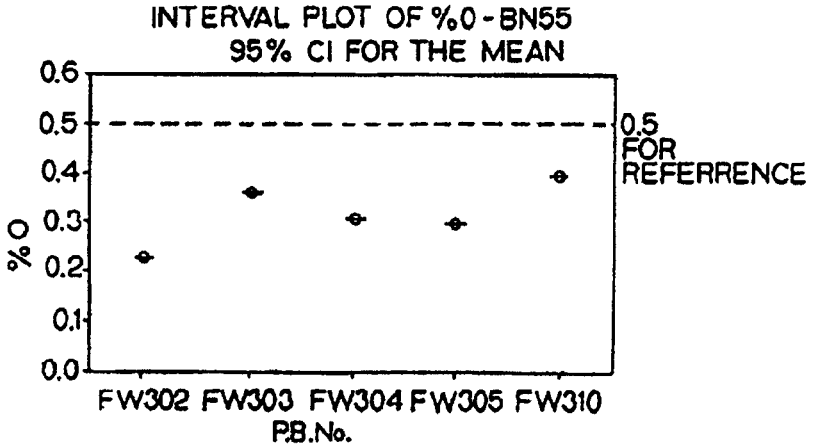
FIG. 8 is an interval plot of the oxygen content (percent oxygen) of the as-produced powder for the BN55 powder grade produced by differing methods of production.

Referring to FIG. 8, the percent (%) oxygen content for the five batches processed in aqueous media with emulsion, are within the acceptable range. These results therefore show that articles made from batches processed in aqueous media with emulsion exhibit a satisfactory range of this property (i.e., oxygen content) so as to thereby demonstrate the effectiveness of using aqueous media as compared to solvent-based milling media.

Figure 9:
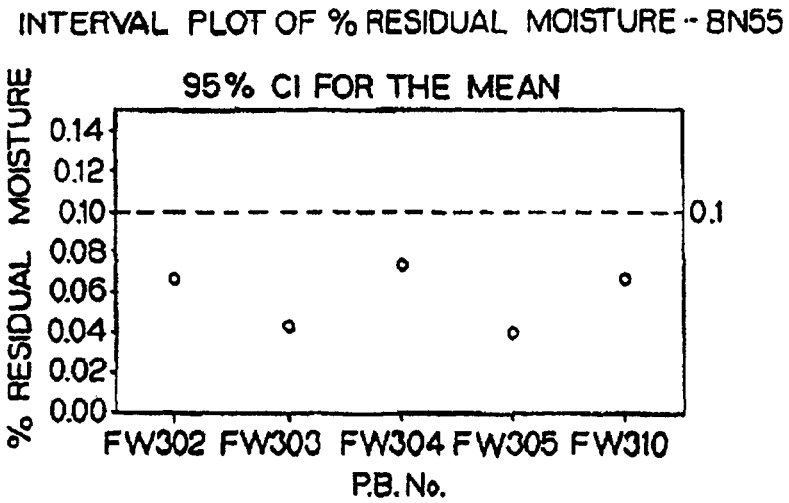
FIG. 9 is an interval plot of the percent residual moisture of the as-produced powder for the BN55 powder grade produced by differing methods of production.

Referring to FIG. 9, the percent (%) Residual Moisture for the five batches processed in aqueous media with emulsion, are within the acceptable range. These results therefore show that articles made from batches processed in aqueous media with emulsion exhibit a satisfactory range of this property (i.e., residual moisture) so as to thereby demonstrate the effectiveness of using aqueous media as compared to solvent-based milling media.

Figure 10:
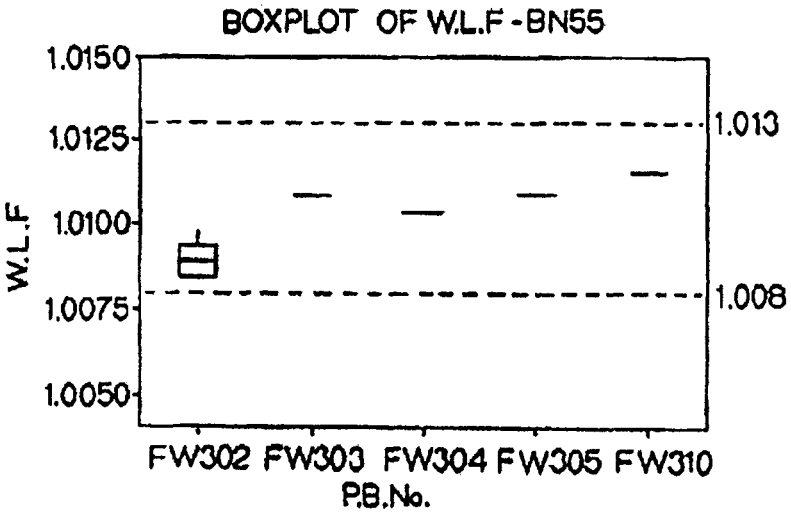
FIG. 10 is a box plot of the W.L.F. for the BN55 powder grade produced by differing methods of production.

Referring to FIG. 10, the Weight Loss Factor (W.L.F.) for the five batches processed in aqueous media with emulsion, are within the acceptable range. These results therefore show that articles made from batches processed in aqueous media with emulsion exhibit a satisfactory range of this property (i.e., W.L.F.) so as to thereby demonstrate the effectiveness of using aqueous media as compared to solvent-based milling media.

Figure 13:
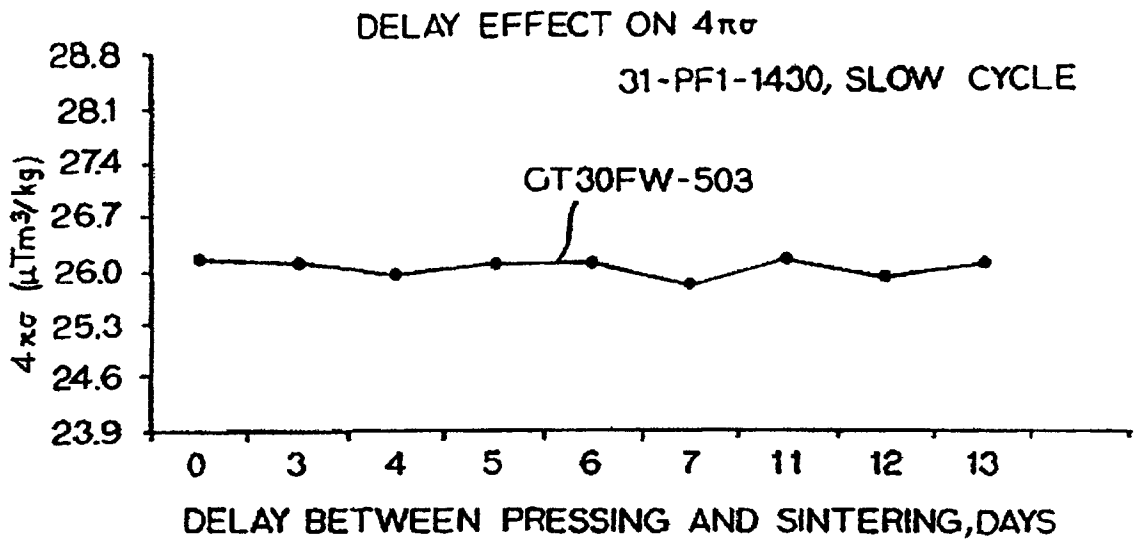
FIG. 13 is a plot of the delay between pressing and sintering as measured in days vs. the $4\pi\sigma$ (micro-$Tm^3$/kg) value for GT30 powder grade Batch No. FW-503A.

Referring to FIG. 13, which pertains to the GT30 powder grade and batch FW503A, it appears that a delay between the pressing and the sintering did not impact the value of the $4\pi\sigma$ as measured in micro-$Tm^3$/kg. The green compact which is stored in the ambient atmosphere is stable and no significant carbon loss was observed. These results therefore show that articles made from batches processed in aqueous media with emulsion exhibit a satisfactory range of these properties (i.e., magnetic saturation and carbon loss) so as to thereby demonstrate the effectiveness of using aqueous media as compared to solvent-based milling media.

Figure 15:
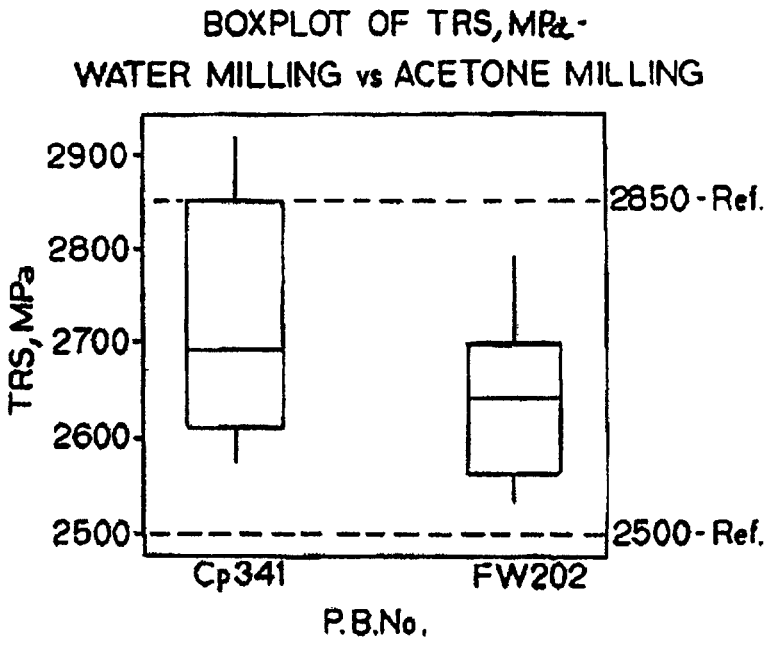
FIG. 15 is a box plot of the transverse rupture strength (TRS) in MPa for the BN45 powder grade comparing the production wherein one method used acetone as the milling fluid (Batch No. Cp 341) and the other method used an aqueous slurry (Batch No. FW 202).

Referring to FIG. 15, which pertains to the BN45 powder grade, batch FW202, it appears that the transverse rupture strength (TRS) of the sintered article is comparable between the aqueous milled powder batch (FW202) and acetone-milled batch Cp341. These results therefore show that articles made from batches processed in aqueous media with emulsion demonstrate the effectiveness of using aqueous media as compared to solvent-based milling media.

It become apparent that the present invention provides a hard material such as, for example, a cemented (cobalt) tungsten carbide, and a method of making such cemented (cobalt) tungsten carbide from an aqueous hard material milling slurry wherein the slurry contains one or more additives and the oxygen pick up by the hard material is minimized. It is also apparent that the present invention provides a hard material such as, for example, a cemented (cobalt) tungsten carbide, and a method of making such cemented (cobalt) tungsten carbide from an aqueous hard material milling slurry wherein the components of the slurry do not experience excessive sedimentation or excessive segregation so as to result in the reduction of the compaction pressure of the resultant hard material powder which helps avoid cracks, pits or any other compaction defects in the green parts. Further, it also is apparent that the present invention provides a hard material such as, for example, a cemented (cobalt) tungsten carbide, and a method of making such cemented (cobalt) tungsten carbide from an aqueous hard material milling slurry wherein there is a homogeneous dispersion of the additives useful to facilitate the pressing of the resultant hard material powder so as to result in the reduction of the compaction pressure of the resultant hard material powder which helps avoid cracks, pits or any other compaction defects in the green parts.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. An aqueous emulsion for use in aqueous milling of hard material powder components in an aqueous slurry, the aqueous emulsion comprising:

an oxidation inhibitor in an amount between about 0.6 weight percent and about 1.4 weight percent of the hard material powder components in the aqueous slurry;

paraffin wax in an amount up to about 2.75 weight percent of the hard material powder components in the aqueous slurry;

myristic acid in an amount between about 0.10 weight percent and about 0.50 weight percent of the hard material powder components in the aqueous slurry; and balance being water.

2. The aqueous emulsion according to claim 1 wherein the aqueous emulsion comprising the oxidation inhibitor in an amount between about 0.8 weight percent and about 1.2 weight percent of the hard material powder components in the aqueous slurry; and the myristic acid in an amount between about 0.13 weight percent and about 0.30 weight percent of the hard material powder components in the aqueous slurry.

3. The aqueous emulsion according to claim 1 wherein the aqueous emulsion comprising the paraffin wax in an amount between about 0.25 weight percent and about 0.75 weight percent of the hard material powder components in the aqueous slurry.

4. The aqueous emulsion according to claim 1 wherein the aqueous emulsion comprising the paraffin wax in an amount between about 0.40 weight percent and about 0.60 weight percent of the hard material powder components in the aqueous slurry.

5. The aqueous emulsion according to claim 1 wherein the aqueous emulsion comprising the oxidation inhibitor in an amount equal to about 1.0 weight percent of the hard material powder components in the aqueous slurry; the paraffin wax in an amount equal to about 0.50 weight percent of the hard material powder components in the aqueous slurry; the myristic acid in an amount equal to about 0.15 weight percent of the hard material powder components in the aqueous slurry; and balance being water.

6. The aqueous emulsion according to claim 1 wherein the aqueous emulsion comprising the oxidation inhibitor in an amount equal to about 1.0 weight percent of the hard material powder components in the aqueous slurry; the paraffin wax in an amount equal to about 2.50 weight percent of the hard material powder components in the aqueous slurry; the myristic acid in an amount equal to about 0.15 weight percent of the hard material powder components in the aqueous slurry; and balance water.

7. The aqueous emulsion according to claim 1 wherein the oxidation inhibitor is selected from the group comprising a polyvinyllactam, triethanolamine and hexamine.

8. The aqueous emulsion according to claim 1 wherein the water is selected from the group comprising de-mineralized water and de-ionized water.

9. A method of making an aqueous emulsion for use in milling an aqueous slurry of hard material powder components, the method comprising the following steps:

mixing together under heating an oxidation inhibitor in an amount between about 0.6 weight percent and about 1.4 weight percent of the hard material powder components in the aqueous slurry and water to form an oxidation inhibitor-water mixture;

melting paraffin wax in an amount up to about 2.75 weight percent of the hard material powder components in the aqueous slurry and myristic acid in an amount between about 0.10 weight percent and about 0.50 weight percent of the hard material powder components in the aqueous slurry to form a paraffin wax-myristic acid solution;

adding the oxidation inhibitor-water mixture into the paraffin wax-myristic acid solution to form a pre-blended emulsion; and blending the pre-blended emulsion to form the aqueous emulsion.

10. The method of making an aqueous emulsion according to claim 9 wherein the oxidation inhibitor-water mixture is at a temperature between about 50° C. and about 60° C. when added into the paraffin wax-myristic acid solution.

11. The method of making an aqueous emulsion according to claim 9 wherein the paraffin wax is in an amount between about 0.25 weight percent and about 0.75 weight percent of the hard material powder components in the aqueous slurry.

12. The method of making an aqueous emulsion according to claim 9 wherein the oxidation inhibitor is selected from the group comprising a polyvinyllactam, triethanolamine and hexamine.

13. A method of making an aqueous slurry of hard material powder components, the method comprising the steps of:

mixing together under heating an oxidation inhibitor in an amount between about 0.6 weight percent and about 1.4 weight percent of the hard material powder components in the aqueous slurry and water to form an oxidation inhibitor-water mixture;

melting paraffin wax in an amount up to about 2.75 weight percent of the hard material powder components in the aqueous slurry and myristic acid in an amount between about 0.10 weight percent and about 0.50 weight percent of the hard material powder components in the aqueous slurry to form a paraffin wax-myristic acid solution;

adding the oxidation inhibitor-water mixture into the paraffin wax-myristic acid solution to form a pre-blended emulsion;

blending the pre-blended emulsion to form an aqueous emulsion;

combining the aqueous emulsion and hard material powder components wherein the hard material powder components comprising hard carbide powder and metallic binder powder; adding water to the combination of the aqueous emulsion and hard material powder components to form a slurry; and milling the slurry for a pre-selected time to from a milled slurry.

14. The method of making an aqueous slurry according to claim 13 wherein the paraffin wax is in an amount between about 0.25 weight percent and about 0.75 weight percent of the hard material powder components in the aqueous slurry.

15. A method of making a hard material powder from hard material powder components, the method comprising the steps of:

mixing together under heating an oxidation inhibitor in an amount between about 0.6 weight percent and about 1.4 weight percent of the hard material powder components in the aqueous slurry and water to form an oxidation inhibitor-water mixture;

melting paraffin wax in an amount up to about 2.75 weight percent of the hard material powder components in the aqueous slurry and myristic acid in an amount between about 0.10 weight percent and about 0.50 weight percent of the hard material powder components in the aqueous slurry to form a paraffin wax-myristic acid solution;

adding the oxidation inhibitor-water mixture into the paraffin wax-myristic acid solution to form a pre-blended emulsion;

blending the pre-blended emulsion to form an aqueous emulsion;

combining the aqueous emulsion and hard material powder components wherein the hard material powder components comprising hard carbide powder and metallic binder powder; adding water to the combination of the aqueous emulsion and hard material powder components to form a slurry;

milling the slurry for a pre-selected time to from a milled slurry; and drying the milled slurry to form the hard material powder wherein the drying is selected from the group consisting of vacuum drying and spray drying.

16. The method of making a hard material powder according to claim 15 wherein when the drying is vacuum drying, the paraffin wax is in an amount between about 0.25 weight percent and about 0.75 weight percent of the hard material powder components.

17. The method of making a hard material powder according to claim 15 wherein when the drying is spray drying, the paraffin wax is in an amount up to about 2.75 weight percent of the hard material powder components in the aqueous slurry.

18. A method of making a hard material article from hard material powder components, the method comprising the steps of:

mixing together under heating an oxidation inhibitor in an amount between about 0.6 weight percent and about 1.4 weight percent of the hard material powder components in the aqueous slurry and water to form an oxidation inhibitor-water mixture;

melting paraffin wax in an amount up to about 2.75 weight percent of the hard material powder components in the aqueous slurry and myristic acid in an amount between about 0.10 weight percent and about 0.50 weight percent of the hard material powder components in the aqueous slurry to form a paraffin wax-myristic acid solution;

adding the oxidation inhibitor-water mixture into the paraffin wax-myristic acid solution to form a pre-blended emulsion;

blending the pre-blended emulsion to form an aqueous emulsion;

combining the aqueous emulsion and hard material powder components wherein the hard material powder components comprising hard carbide powder and metallic binder powder; adding water to the combination of the aqueous emulsion and hard material powder components to form a slurry;

milling the slurry for a pre-selected time to from a milled slurry;

drying the milled slurry to form the hard material powder wherein the drying is selected from the group consisting of vacuum drying and spray drying; and consolidating the hard material powder to form the hard material article.

19. The method of making a hard material article according to claim 18 wherein when the drying is vacuum drying, the paraffin wax is in an amount between about 0.25 weight percent and about 0.75 weight percent of the hard material powder components.

20. The method of making a hard material article according to claim 18 wherein when the drying is spray drying, the paraffin wax is in an amount up to about 2.75 weight percent of the hard material powder components.

* * * * *